US007077510B2

(12) United States Patent
Iriguchi

(10) Patent No.: US 7,077,510 B2
(45) Date of Patent: Jul. 18, 2006

(54) INK-JET PRINTING HEAD

(75) Inventor: Akira Iriguchi, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 21 days.

(21) Appl. No.: 10/685,817

(22) Filed: Oct. 14, 2003

(65) Prior Publication Data

US 2004/0080585 A1 Apr. 29, 2004

(30) Foreign Application Priority Data

Oct. 15, 2002 (JP) ..... 2002-300763

(51) Int. Cl.
*B41J 2/045* (2006.01)

(52) U.S. Cl. ..... 347/68; 347/72

(58) Field of Classification Search ..... 347/20, 347/68–73

See application file for complete search history.

(56) References Cited

U.S. PATENT DOCUMENTS 4,549,191 A * 10/1985 Fukuchi et al. ..... 347/71
4,730,197 A * 3/1988 Raman et al. ..... 347/40
5,428,382 A * 6/1995 Shimosato et al. ..... 347/71
5,748,214 A * 5/1998 Usui et al. ..... 347/70
5,956,059 A * 9/1999 Usui ..... 347/71
6,382,754 B1 * 5/2002 Morikoshi et al. ..... 347/11
6,682,178 B1 * 1/2004 Yazaki ..... 347/70
2002/0105567 A1 8/2002 Yamada et al.

* cited by examiner

*Primary Examiner*—Manish Shah
*Assistant Examiner*—Geoffrey S. Mruk
(74) *Attorney, Agent, or Firm*—Reed Smith LLP

(57) ABSTRACT

An ink-jet printing head comprising a flow-passage unit and an actuator unit laminated on each other, wherein the flow-passage unit has nozzles and pressure chambers communicating with the respective nozzles, and the actuator unit is operable to apply pressure to ink in each pressure chamber, and wherein each pressure chamber communicates at one of its opposite longitudinal ends with the corresponding nozzle, and at the other longitudinal end with an ink supply source, and is formed so as to be open in one of the opposite surfaces of the flow-passage unit, such that each pressure chamber is partially defined by the actuator unit, and wherein each pressure chamber has a depth of 35 μm–45 μm in a direction perpendicular to the opposite surfaces of the flow-passage unit.

10 Claims, 8 Drawing Sheets

INK-JET PRINTING HEAD

The present application is based on Japanese Patent Application No. 2002-300763 filed Oct. 15, 2002, the contents of which are incorporated herein by reference.

BACKGROUND OF THE INVENTION

1. Field of the Invention

The present invention relates to an ink-jet printing head arranged to eject or deliver droplets of an ink from respective nozzles communicating with respective pressure chambers, upon pressurization of ink in the pressure chambers.

2. Discussion of Related Art

U.S. Patent Application Publication No. 2002/0105567 (in particular, FIGS. 7 and 8, and paragraphs [0055] and [0056]) which corresponds to JP-A-2002-273894 discloses an ink-jet printing head including a flow-passage unit and an actuator unit which are laminated on each other. The flow-passage unit has nozzles and pressure chambers which are formed so as to be open in the respective opposite major surfaces such that the nozzles are held in communication with the respective pressure chambers. The actuator unit is constructed and operable to apply pressure to ink in each pressure chamber. The flow-passage unit and the actuator unit are superposed on each other such that the pressure chambers are located adjacent to the actuator unit. In the ink-jet printing head of this type, a drop of the ink is ejected from each nozzle when the volume of the corresponding pressure chamber is changed by deformation of a corresponding active portion of the actuator unit in the direction of lamination of the flow-passage and actuator units, which deformation takes place based on a piezoelectric effect produced at the active portion.

Each of the pressure chambers formed in the ink-jet printing head disclosed in the above-identified publication U.S. Pat. No. 2002/0105567 has a generally rectangular shape that is elongate in one direction, as seen in a plane parallel to the opposite major surfaces of the flow-passage unit. The longitudinal direction of each pressure chamber is perpendicular to the longitudinal direction of the ink-jet printing head, that is, parallel to the direction of width of the head. The pressure chambers are arranged adjacent to and spaced apart from each other in the longitudinal direction of the ink-jet printing head, in at least one row extending in the longitudinal direction, so that the nozzles are equally spaced apart from each other at an extremely small spacing pitch in the longitudinal direction of the head. The pressure chambers have a depth of 50 μm–150 μm that is equal to the thickness of a metal plate through which the pressure chambers are formed. Such pressure chambers arranged in an ink-jet printing head as disclosed in the above-identified publication typically has a length of about 3.8 mm and a width of about 250 μm. Such an actuator unit as disclosed in the above-identified publication is typically driven with a drive voltage of 21.5 V, at a maximum drive frequency of 18 kHz, and an ink droplet is ejected from the nozzle at an ejection velocity or a delivery rate of about 6–7 m/sec.

An ink-jet printing head is generally operated with a so-called "fill-before-fire" action to eject an ink droplet from each nozzle. The fill-before-fire action involves deformation of the active portion of the actuator unit so as to initially increase the volume of the corresponding pressure chamber from a nominal value in a non-energized state of the active portion. An increase in the volume of the pressure chamber due to the deformation causes a pressure wave to be generated within the pressure chamber. The pressure wave propagates through the pressure chamber in its longitudinal direction. When the pressure within the pressure chamber has been raised back to an original positive value, the active portion is de-energized to restore the pressure chamber to the original shape, and to reduce the volume of the pressure chamber back to the nominal value, thereby pressurize the ink within the pressure chamber. The fill-before-fire action involves mutual superimposition of the pressure wave and the pressure application due to the deformation of the active portion back to the original shape, permitting the ink droplet to be ejected at a sufficiently high velocity, with a comparatively low drive voltage applied to the active portion of the actuator unit.

In an effort to meet a recently growing need for increasing the printing speed of the ink-jet printing head, it has been attempted to increase the maximum drive frequency of the actuator unit. In the fill-before-fire action, the maximum drive frequency depends upon the time required for reciprocal propagation of the pressure wave through the pressure chamber in its longitudinal direction, namely, depends upon the length of the pressure chamber, as is understood from the foregoing explanation of the fill-before-fire action. Accordingly, the maximum drive frequency can be increased by reducing the length of the pressure chamber.

However, a reduction in the length of the pressure chamber without changing the drive voltage of the active portion of the actuator unit causes the ink ejection velocity to be accordingly lowered, giving rise to a risk of deterioration of a quality of an image formed by the ink droplets. The ink ejection velocity can be increased by increasing the drive voltage of the actuator unit (to 25 V, for example). However, an increase in the drive voltage results in not only an increase in the cost of manufacture of the associated components such as electric circuits and driver ICs, but also an increase in the amount of heat generation from the actuator unit, which requires the provision of additional components for dissipating the generated heat. While the ink ejection velocity can also be increased by reducing the diameter of each nozzle, this solution undesirably results in a decrease in the amount of the ink to be ejected from the nozzle.

Thus, the ink-jet printing head known in the art is not capable of ejecting ink droplets at a sufficiently high velocity, at a sufficiently high drive frequency and with a sufficiently low drive voltage. For enhancing the quality of the image formed by the printing head, it is desired to increase the ink ejection velocity as much as possible.

SUMMARY OF THE INVENTION

The present invention was made in view of the drawback experienced in the prior art discussed above. It is therefore an object of the present invention to provide an ink-jet printing head capable of ejecting ink droplets at a sufficiently high velocity, at a sufficiently high drive frequency and with a sufficiently low drive voltage.

In an effort to overcome the drawback in the prior art discussed above, the present inventor made an extensive study and selected the depth of each pressure chamber as a parameter to be adjusted to obtain an intended result. The inventor selected the width of each pressure chamber, in view of difficulty to adjust the length of each pressure chamber which depends upon the maximum drive frequency of the actuator unit, difficulty to adjust the width of each pressure chamber which is determined by the spacing pitch of the nozzles and the spacing distance between the adjacent pressure chambers, and undesirability of an adjustment of the diameter of each nozzle which results in a change in the amount of the ink to be ejected. The present inventor found that a decrease in the depth of each pressure chamber makes it possible to reduce the required drive voltage, without lowering the ink ejection velocity. The inventor further found that the adjustment of the operating condition of the actuator unit so as to maintain uniform ink ejection velocity becomes more and more difficult as the depth of each pressure chamber is decreased. In view of these findings, the present inventor arrived at a conclusion that the ink-jet printing head wherein each pressure chamber has a depth of 35 μm–45 μm is operable to eject ink droplets at a high velocity at a sufficiently high maximum drive frequency, without increasing the drive voltage.

Namely, the object indicated above may be achieved according to the principle of this invention, which provides an ink-jet printing head comprising a flow-passage unit and an actuator unit laminated on each other, the flow-passage unit having nozzles and pressure chambers communicating with the nozzles, respectively, and the actuator unit being operable to apply pressure to ink in each pressure chamber, and wherein each of the pressure chambers communicates at one of opposite longitudinal ends thereof with a corresponding one of the nozzles, and at the other of the opposite longitudinal ends with an ink supply source, and is formed so as to be open in one of opposite surfaces of the flow-passage unit, such that each pressure chamber is partially defined by the actuator unit, the ink-jet printing head being characterized in that each of the pressure chambers has a depth of 35 μm–45 μm in a direction perpendicular to the one of opposite surfaces of the flow-passage unit.

In the ink-jet printing head of the present invention constructed as described above, the ink ejection velocity is made higher than in the known ink-jet printing head, without an increase in the required drive voltage, and the stability of control of the actuator unit is improved, so that the stability in quality of an image formed by the ejected ink droplets is accordingly improved.

The flow-passage unit preferably includes a first plate through which the pressure chambers are formed, a second plate formed with the ink supply source, and a third plate formed with the nozzles, the first plate being fixed to the actuator unit and the second plate being sandwiched by the first and third plates.

The actuator unit preferably includes a plurality of piezoelectric sheets that are stacked while sandwiching a plurality of individual electrodes and a common electrode alternately, the actuator unit having a plurality of active portions that are defined over the respective pressure chambers by the stacked individual electrodes and the common electrodes and are deformable to apply the pressure to the ink in the respective pressure chambers.

The depth of each pressure chamber is preferably selected within a range of 37 μm–43 μm, to obtain the above-indicated advantage of the invention with increased stability, more preferably selected within a range of 38 μm–42 μm, and most preferably selected within a range of 39 μm–41 μm.

Preferably, each pressure chamber has a width of 150 μm–300 μm in a direction perpendicular to a longitudinal direction thereof in which the opposite longitudinal ends are opposed to each other, and a length of 1.0 mm–4.0 mm in the longitudinal direction.

As described below in detail, it was found that where the depth, width and length of each pressure chamber is about 40 μm, about 250 μm and about 1.8 mm, respectively, the ink-jet printing head is capable of ejecting droplets of the ink from the nozzles at a velocity of about 9 m/sec. when the actuator unit is driven at a maximum frequency of about 24 kHz with a drive voltage of about 20.5 V.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Figure 1:
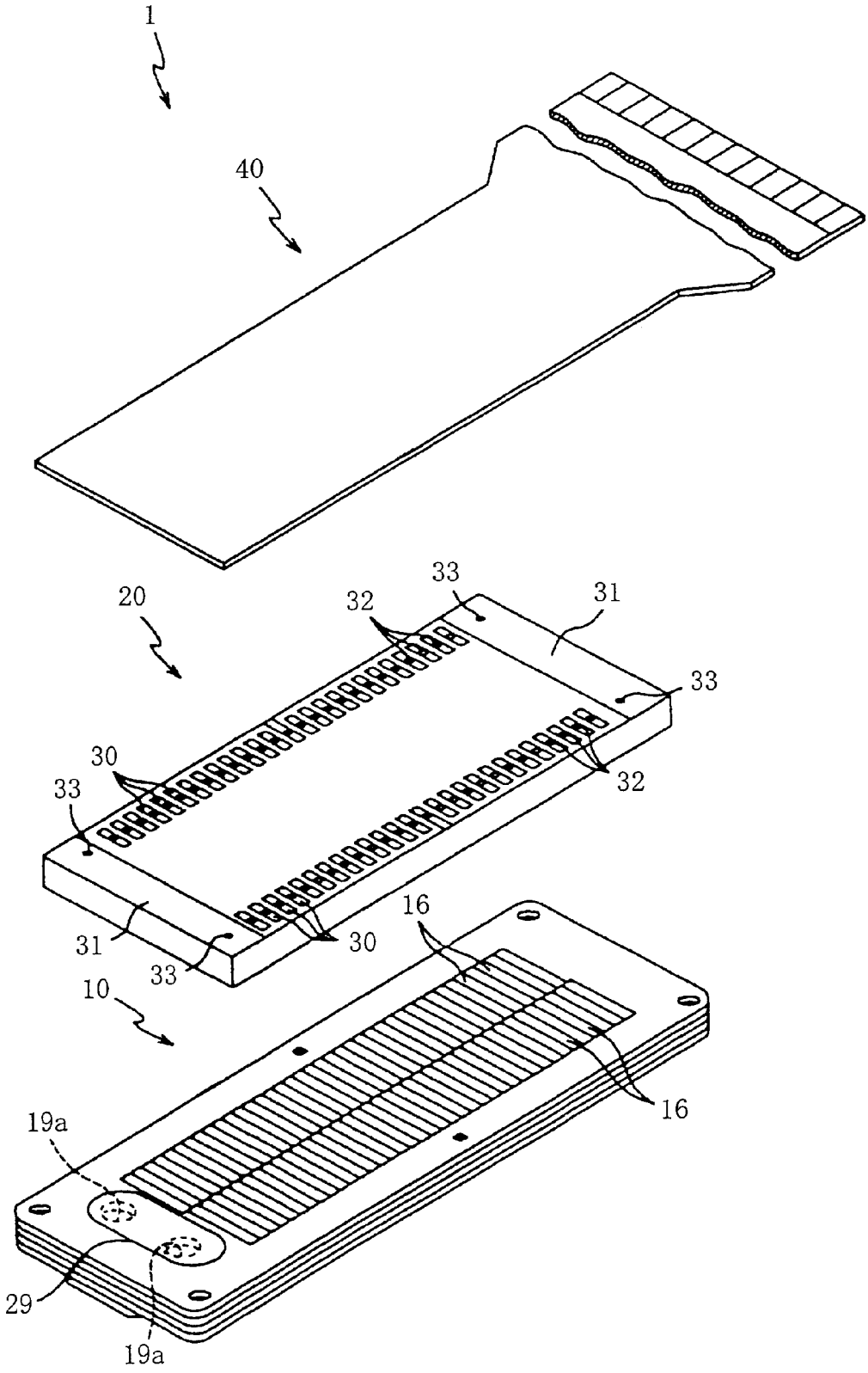
FIG. 1 is an exploded perspective view of an ink-jet printing head constructed according to one embodiment of this invention.

Referring to the drawings, one preferred embodiment of the present invention will be described.

There will be briefly described an ink-jet printing head 1 of piezoelectric type constructed according to the preferred embodiment of the invention, by reference to the exploded perspective view of FIG. 1. As shown in this figure, the ink-jet printing head 1 includes a flow-passage unit 10 in the form of a generally rectangular parallelepiped, and an actuator unit 20 in the form of a similar generally rectangular parallelepiped formed on the flow-passage unit 10. To the upper major surface of the actuator unit 20, there is bonded a flexible flat cable (flexible printed-circuit board) 40 for electrical connection of the actuator unit 20 to an external device. As described below in detail by reference to FIG. 2, the flow-passage unit 10 of the present ink-jet printing head 1 has ink outlet nozzles (hereinafter referred to simply as "nozzles") 54 formed therein such that the nozzles 54 are open in the lower major surface of the flow-passage unit 10, for ejecting droplets of an ink downwards.

Figure 2:
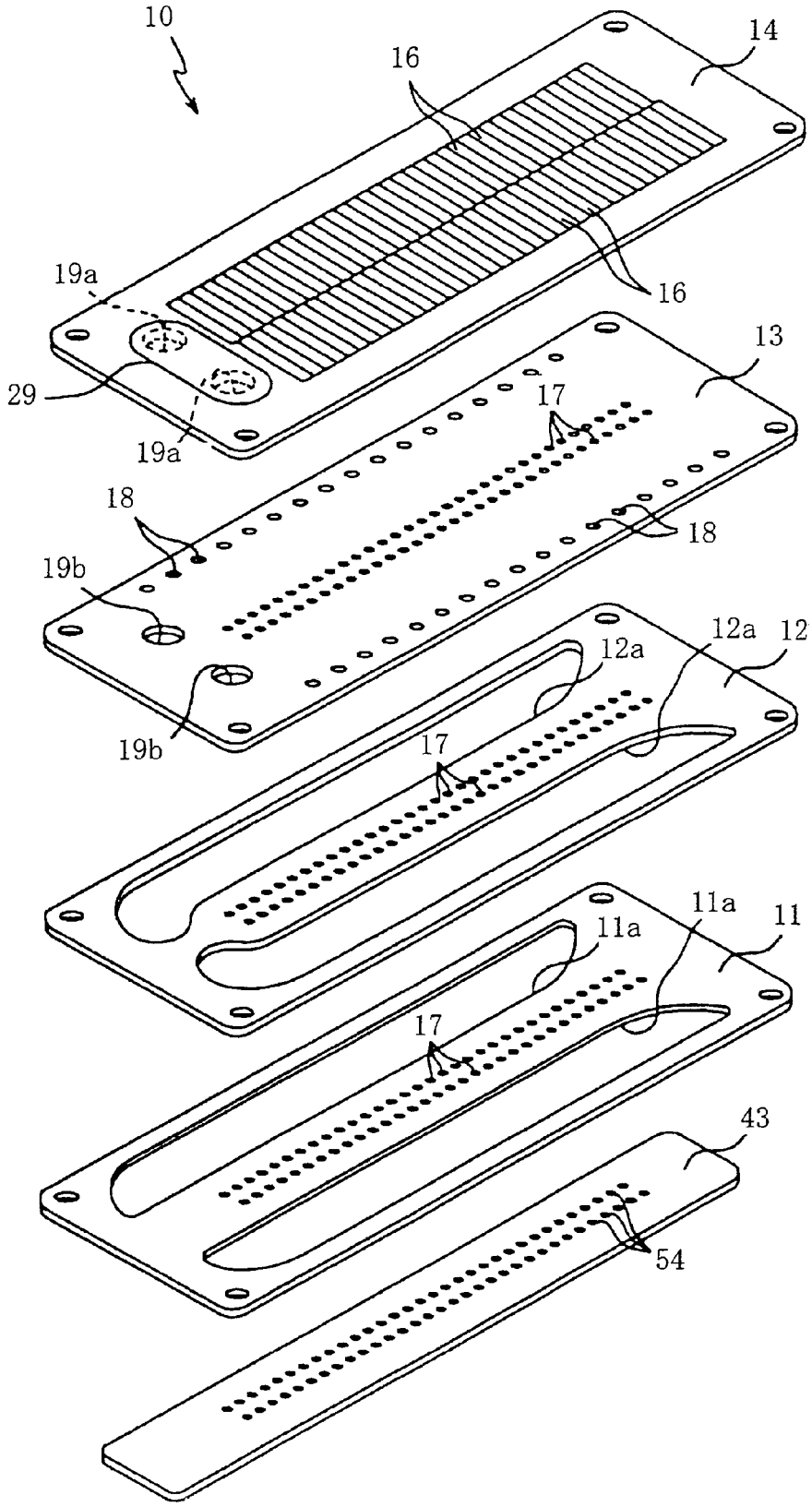
FIG. 2 is an exploded perspective view of a flow-passage unit of the ink-jet printing head of FIG. 1.

Then, the flow-passage unit 10 will be described referring to the exploded perspective view of FIG. 2. As shown in this figure, the flow-passage unit 10 is a laminar structure consisting of five thin sheets which are formed of electrically conductive materials and laminated on each other and bonded together. These five thin sheets consist of a nozzle plate 43, a first manifold plate 11, a second manifold plate 12, a spacer plate 13 and a cavity plate 14. Each of the plates 11–14 is formed of a nickel-steel alloy including 42% of nickel. Each of the plates 11–13 has a thickness of 50 μm–150 μm while the plate 14 has a thickness of 35 μm–45 μm. The nozzle plate 43 has the above-indicated nozzles 54 each having an extremely small diameter. The nozzles 54 are formed through the thickness of the nozzle plate 43, in two straight rows extending in the longitudinal direction of the flow-passage unit 10 (in the longitudinal direction of the nozzle plate 43), such that the nozzles 54 of each row are equally spaced apart from each other at a relatively small spacing pitch and such that each of the nozzles 54 of one of the two rows is interposed between the adjacent two nozzles 54 of the other row in the longitudinal direction of the nozzle plate 43. Thus, the nozzles 54 are formed in the two rows, in a zigzag pattern.

The second manifold plate 12 has two elongate manifold chambers 12*a* formed through its thickness such that the two manifold chambers 12*a* extend in the longitudinal direction of the second manifold plate 12 and are spaced apart from each other in the transverse direction of the second manifold plate 12, and such that the two rows of the nozzles 54 are located between the two manifold chambers 12*a*, as viewed from the top of the flow-passage unit 10. The cavity plate 14 has pressure chambers 16 formed therethrough in two parallel straight rows. The two manifold chambers 12*a* are aligned with the respective two rows of pressure chambers 16, as viewed from the top of the flow-passage unit 10. Each of the manifold chambers 12*a* has a length larger than that of the rows of pressure chambers 16.

The first manifold plate 11 formed between the second manifold plate 12 and the nozzle plate 43 has two manifold chambers 11*a* substantially identical in shape with the manifold chambers 12*a*. The manifold chambers 11*a* and the manifold chambers 12*a* cooperate to form two manifolds corresponding to the respective two rows of pressure chambers 16.

The multiple pressure chambers 16 are formed through the cavity plate 14 in the two parallel straight rows, as described above, such that each pressure chamber 16 is elongate in the transverse direction of the cavity plate 14 (in the direction of width of the cavity plate 14), namely, extends in the transverse direction perpendicular to the rows of the pressure chambers 16, and has a relatively small width. Each elongate pressure chamber 16 has a generally rectangular shape as viewed from the top of the flow-passage unit 10. The two rows of the pressure chambers 16 are located on the respective opposite sides of a widthwise centerline of the cavity plate 14. The pressure chambers 16 of each of the two rows are equally spaced apart from each other such that each of the pressure chambers 16 of one of the two rows is interposed between the adjacent pressure chambers 16 of the other row in the direction of the rows. Described more precisely, one of the opposite longitudinal end portions of each pressure chamber 16 of one of the two rows, which is nearer to the widthwise centerline, is located between the corresponding longitudinal end portions of the adjacent two pressure chambers 16 of the other row. Thus, the pressure chambers 16 are also formed in the two rows, in a zigzag pattern.

Each of the pressure chambers 16 is held, at one of the opposite longitudinal ends, in communication with the corresponding one of the nozzles 54 formed in the zigzag pattern, through a corresponding one of small through-holes 17 formed in two rows in a zigzag pattern through the spacer plate 13 and the first and second manifold plates 11, 12. Each pressure chamber 16 is held, at the other longitudinal end, with the manifold chambers 11*a*, 12*a* formed in the manifold plates 11, 12, through a corresponding one of through-holes 18 that are formed in two straight rows through the spacer plate 13 such that the rows of the through-holes 18 are located near the respective opposite long side edges of the spacer plate 13. The cavity plate 14 has two inlet holes 19*a* formed through one of its opposite end portions, while the spacer plate 13 has corresponding two inlet holes 19*b* which are held in communication with the respective two manifold chambers 12*a*, 12*a*. As shown in FIG. 2, the cavity plate 14 which is the uppermost layer of the flow-passage unit 10 has a filter 29 covering the open ends of the inlet holes 19*a* open in its upper surface. This filter 29 is provided to remove any foreign matter such as dust contained in an ink supplied from an ink cartridge (now shown) which is provided as an ink supply source on an ink-jet printer which is provided with the present ink-jet printing head 1.

The ink supplied into the manifold chambers 11*a*, 12*a* through the inlet holes 19*a*, 19*b* is distributed into the individual pressure chambers 16 through the through-holes 18, and are fed from the pressure chambers 16 to the respective nozzles 54 through the through-holes 17.

Figure 3:
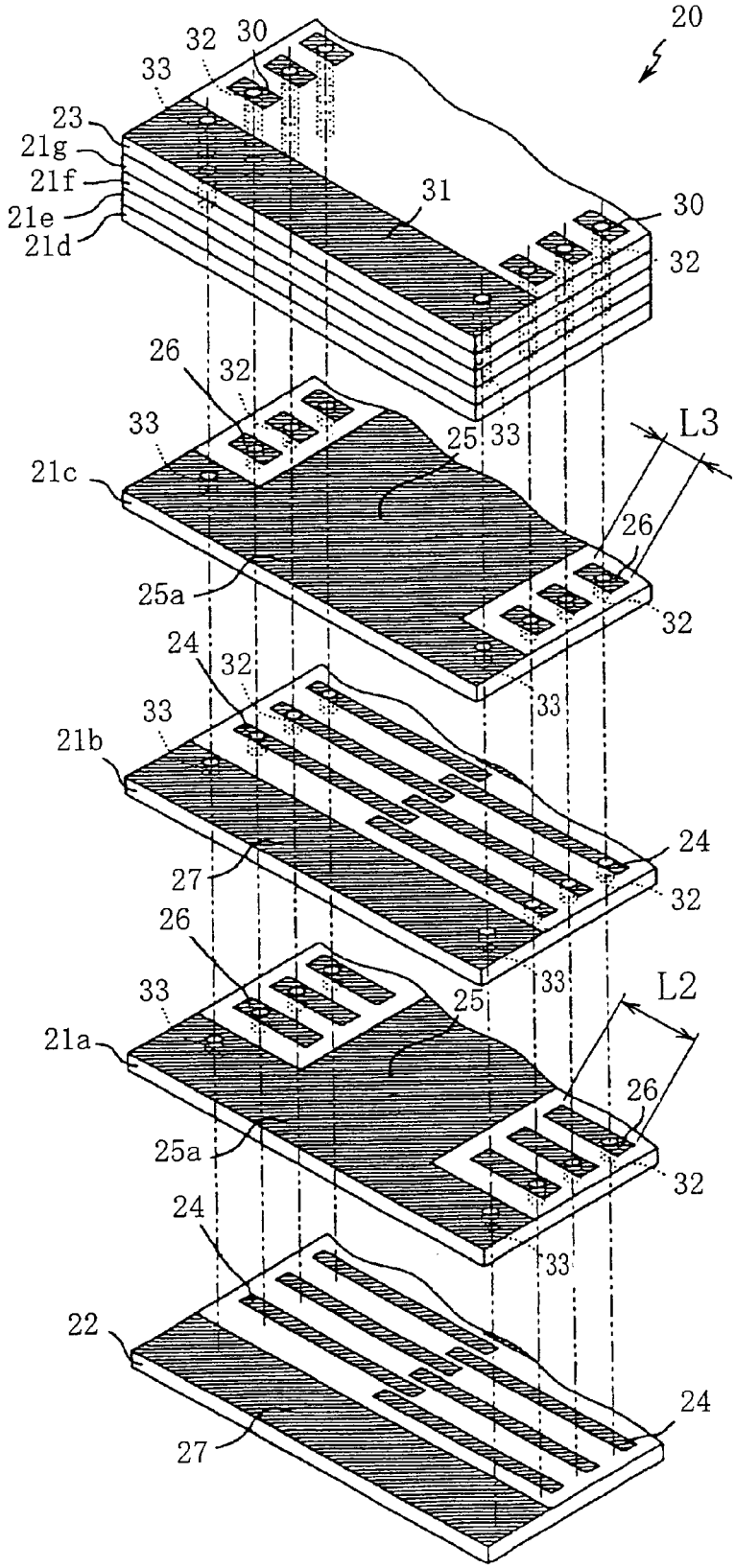
FIG. 3 is a fragmentary exploded perspective view of an actuator unit of the ink-jet printing head of FIG. 1.

Reference is now made to the fragmentary exploded perspective view of FIG. 3, there is shown the actuator unit 20 of the ink-jet printing head 1 of FIG. 1. As shown in FIG. 3, the actuator unit 20 is a laminar structure consisting of nine piezoelectric ceramic sheets 21*a*, 21*b*, 21*c*, 21*d*, 21*e*, 21*f*, 21*g*, 22 and 23 which are superposed on each other. A multiplicity of individual electrodes 24 are formed on the upper surface of each of the piezoelectric ceramic sheets 22, 21*b*, 21*d*, 21*f*, which are the odd-numbered sheets as counted from the lowermost piezoelectric ceramic sheet 22. Each of the individual electrodes 24 takes the form of an elongate rectangular strip extending in the transverse direction (in the direction of width) of the actuator unit 20. The multiple individual electrodes 24 are arranged in two parallel straight rows which extend in the longitudinal direction of the actuator unit 20 and which are aligned with the respective two straight rows of the pressure chambers 16 formed in the flow-passage unit 10. The potentials of the individual electrodes 24 can be controlled independently of each other. A common electrode 25 is formed on the upper surface of each of the piezoelectric ceramic sheets 21*a*, 21*c*, 21*e*, 21*g* which are the even-numbered sheets as counted from the lowermost piezoelectric ceramic sheet 22. The common electrode 25 is formed in a portion of the above-indicated upper surface except its two transversely opposite end portions extending in the longitudinal direction of the piezoelectric ceramic sheet 21*a*, 21*c*, 21*e*, 21*g* in question, so that the common electrode 25 overlaps the individual electrodes 24 except their longitudinal end portions corresponding to the above-indicated two transversely opposite end portions of the upper surface of the sheet 21*a*, 21*c*, 21*e*, 21*g*, as viewed from the top of the actuator unit 20. The lowermost and uppermost piezoelectric ceramic sheets 22, 23 may be replaced by sheets of an electrically insulating material. Each of the sheets 22, 23, 21*a*–21*g* has a thickness of about 30 μm.

The common electrode 25 formed on each of the even-numbered piezoelectric ceramic sheets 21*a*, 21*c*, 21*e*, 21*g* is an elongate generally rectangular strip extending in the longitudinal direction of those sheets, and is located in a widthwise central portion of each sheet, so that the common electrode 25 covers the two rows of the pressure chambers 16 extending in the longitudinal direction of the cavity plate 14, as viewed from the top of the actuator unit 20. The common electrode 25 includes two opposite end potions serving as two integrally formed lead portions 25*a* which are located at the respective longitudinally opposite end portions of the even-numbered piezoelectric ceramic sheet in question and which extend along the substantially entire length of the respective short side edges of the sheet.

Individual dummy electrodes 26 are formed outside the common electrode 25 in two parallel straight rows, in the above-indicated two transversely opposite end portions of the upper surface of each of the even-numbered piezoelectric ceramic sheets 21*a*, 21*c*, 21*e*, 21*g*. Each of the individual dummy electrodes 26 has substantially the same width as the individual electrodes 24, and a smaller length than the individual electrodes 24. The individual dummy electrodes 26 are aligned with the respective individual electrodes 24, as viewed from the top of the actuator unit 20. As shown in FIG. 3, each of the individual dummy electrodes 26 is spaced from the common electrode 25 by a predetermined distance in the longitudinal direction of the electrodes 26. The individual dummy electrodes 26 formed on the piezoelectric ceramic sheet 21*a* and 21*e* (second and sixth sheets as counted from the lowermost sheet 22) have a length L2, while the individual dummy electrodes 26 formed on the piezoelectric ceramic sheets 21*c* and 21*g* (fourth and eighth sheets as counted from the lowermost sheet 22) has a length L3 smaller than the length L2, as indicated in FIG. 3. Further, the common electrodes 25 formed on the piezoelectric ceramic sheets 21*a* and 21*e* has a smaller width than the common electrodes 25 formed on the piezoelectric ceramic sheets 21*c* and 21*g*, as is apparent from FIG. 3.

Common dummy electrodes 27 are formed in the longitudinally opposite end potions of the upper surface of each of the odd-numbered piezoelectric ceramic sheets 22, 21*b*, 21*d*, 21*f*. These common dummy electrodes 27 correspond to the respective lead portions 25*a* of the common electrode 25.

As sown in FIGS. 1 and 3, surface electrodes 30 are formed in two parallel straight rows in the respective two transversely opposite end portions of the upper surface of the uppermost piezoelectric ceramic sheet 23, such that the surface electrodes 30 are aligned with the respective individual electrodes 24. Further, surface electrodes 31 are formed in the respective two longitudinally opposite end portions of the same upper surface, such that the surface electrodes 31 are aligned with the respective lead portions 25*a* of the common electrodes 25.

The piezoelectric ceramic sheets 21*a*, 21*b*, 21*c*, 21*d*, 21*e*, 21*f*, 21*g* and 23, except for the lowermost sheet 22, have through-holes 32 filled with an electrically conductive material for electrically connecting the surface electrodes 30 and the corresponding individual electrodes 24 and individual dummy electrodes 26, such that the through-holes 32 correspond to the respective individual electrodes 24. The piezoelectric ceramic sheets 21*a*–21*g* and 23, except for the lowermost sheet 22, further have through-holes 33 filled with an electrically conductive material for electrically connecting the surface electrodes 31, the corresponding lead portions 25*a* of the common electrodes 25 and the corresponding common dummy electrodes 27.

The through-holes 33 filled with the electrically conductive material may be replaced by connecting electrodes which are formed on the longitudinally opposite end faces of the actuator unit 20, so as to connect the lead portions 25*a* of all of the common electrodes 25 to each other and to the surface electrodes 31. In this case, the lead portions 25*a* are formed so as to be partially exposed on the above-indicated longitudinally opposite end faces. Similarly, the through-holes 32 filled with the electrically conductive material may be replaced by connecting electrodes which are formed on the transversely opposite end faces of the actuator unit 20, so as to connect all of the corresponding individual electrodes 24 to each other and to the surface electrodes 30. In this case, the longitudinal end portions of the individual electrodes 24 which are nearer to the above-indicated transversely opposite end faces are partially exposed on these end faces.

Figure 4:
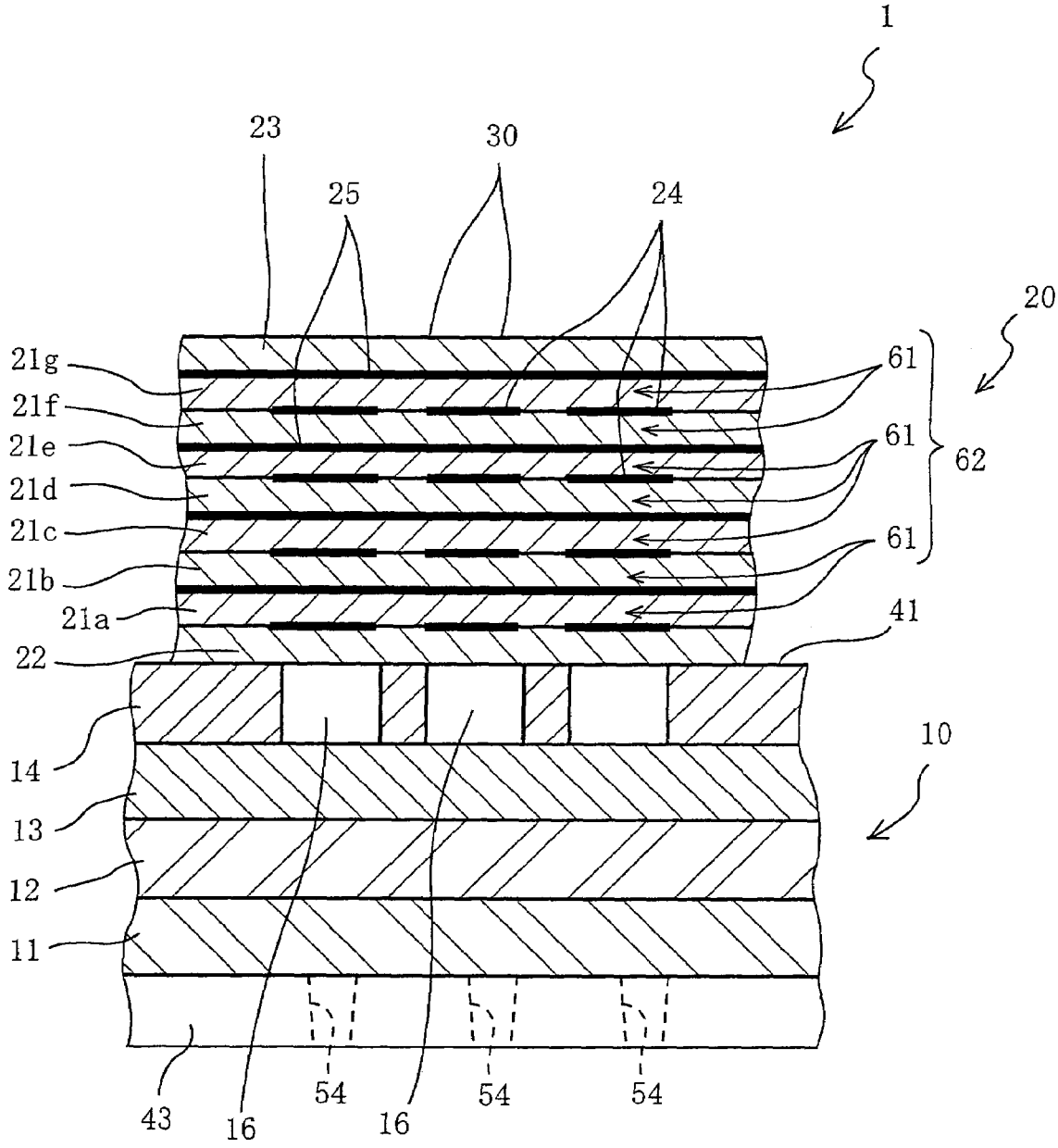
FIG. 4 is a fragmentary elevational view in longitudinal cross section of the ink-jet printing head of FIG. 1.

The lower surface of the actuator unit 20 constructed as described above is coated with an adhesive layer in the form of an adhesive sheet 41 formed of an ink-impermeable synthetic resin material, as shown in FIG. 4. The actuator unit 20 is bonded at its lower surface via the adhesive sheet 41 to the upper surface of the flow-passage unit 10, such that the individual electrodes 24 are aligned with the respective pressure chambers 16, as viewed from the top of the actuator unit 20 and the flow-passage unit 10. Further, the flexible flat cable 40 is bonded to the upper surface of the actuator unit 20, such that the wiring of the cable 40 is electrically connected to the surface electrodes 30, 31. As well known in the art, the portions of the piezoelectric ceramic sheets 21*a*–21*g* which are interposed between the individual electrodes 24 and the common electrodes 25 are subjected to a polarization treatment, more specifically, polarized in a direction from the individual electrodes 24 toward the common electrodes 25, by applying a high positive voltage to all of the individual electrodes 24 while holding the common electrodes 25 connected to the ground.

The adhesive material of the adhesive sheet 41 should have a high degree of impermeability to an ink and a high degree of electrically insulating property, and may be a hot melt type adhesive agent in the form of a film, such as nylon or a polyamide resin including a dimer acid as a major component, and a polyester-based resin. Alternatively, the actuator unit 20 may be bonded at its lower surface to the upper surface of the flow-passage unit 10 after the lower surface of the actuator unit 20 is coated with a polyolefine-based hot melt type adhesive agent.

Figure 5:
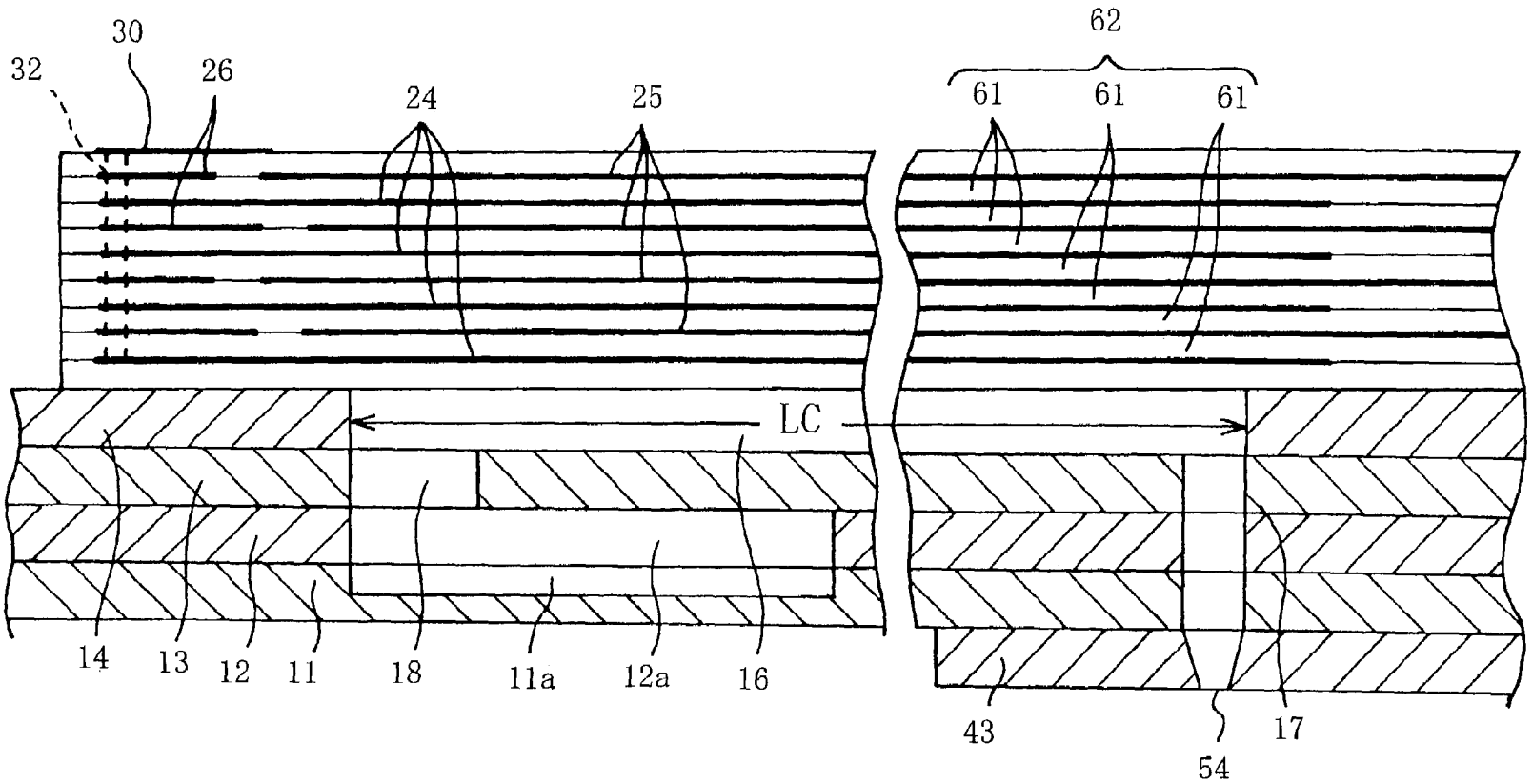
FIG. 5 is a fragmentary elevational view in transverse cross section of the ink-jet printing head of FIG. 1.
Figure 6A:
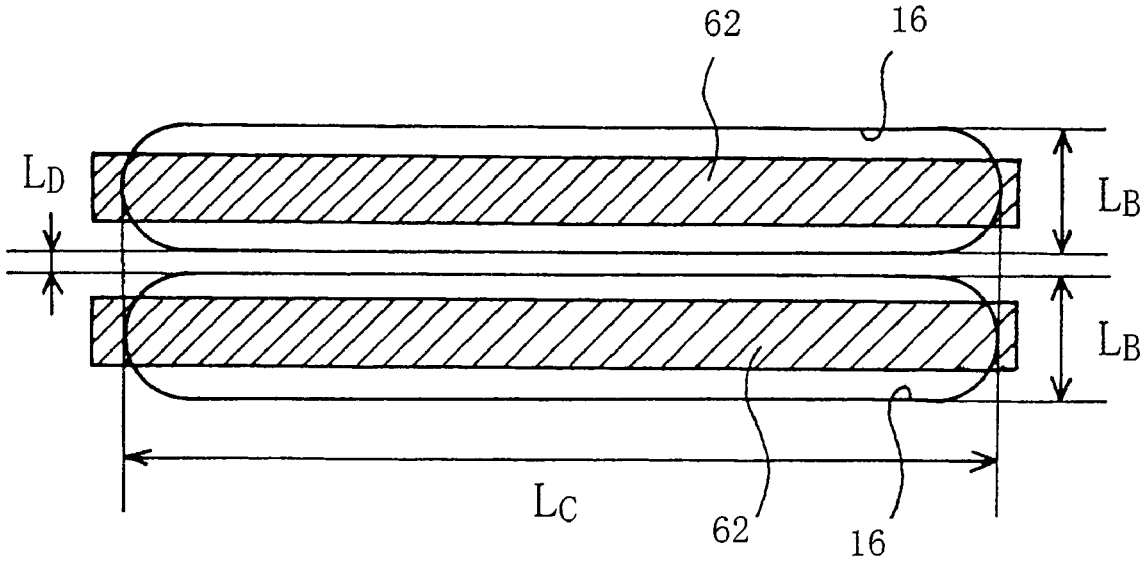
FIG. 6A is a schematic plan view indicating a positional relationship between adjacent pressure chambers of the flow-passage unit and the corresponding arrays of active portions of the actuator unit in the ink-jet printing head of FIG. 1.
Figure 6B:
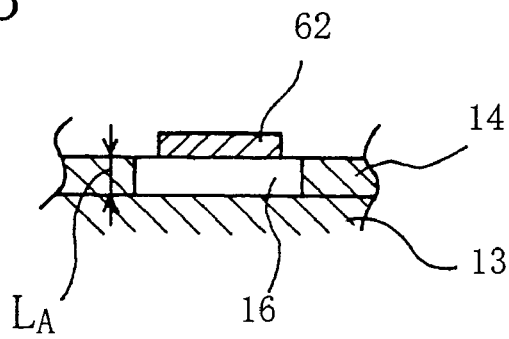
FIG. 6B is a schematic fragmentary elevational view in cross section illustrating the pressure chamber and the corresponding array of active portions.

Referring further to FIGS. 4–6, there will be described a positional relationship between the pressure chambers 16 of the flow-passage unit 10 and respective arrays 62 of active portions 61 of the actuator unit 20. FIG. 4 is a fragmentary elevational view in longitudinal cross section of the ink-jet printing head of FIG. 1 while FIG. 5 is a fragmentary elevational view in transverse cross section. FIG. 6A is a schematic plan view indicating the positional relationship between the adjacent pressure chambers 16 of the flow-passage unit 10 and the corresponding arrays 62 of the active portions 61 of the actuator unit 20 in the ink-jet printing head of FIG. 1, while FIG. 6B is a schematic fragmentary elevational view in cross section illustrating the pressure chamber and the corresponding array of active portions.

Each portion of each piezoelectric ceramic sheet 21*a*–21*g* which is sandwiched between the corresponding one of the multiple individual electrodes 24 and the common electrode 25 that is adjacent to that individual electrode 24 in the direction of thickness of the piezoelectric ceramic sheet functions as the active portion 61 of the actuator unit 20, which is deformed or displaced upon application of a drive voltage to the individual electrode 24, more precisely, expanded and contracted in the direction of thickness of the sheet (in the direction of lamination of the sheets 21*a*–21*g*) owing to a piezoelectric effect, which takes place when an electric field is produced in the above-indicated each portion of the sheet 21*a*–21*g* in the direction of polarization of the actuator unit 20. Thus, the active portions 61 of the piezoelectric ceramic sheets 21*a*–21*g* correspond to the respective individual electrodes 24, and are spaced apart from each other in the direction parallel to the surfaces of the sheets 21*a*–21*g*. The seven active portions 61 of the seven piezoelectric ceramic sheets 21*a*–21*g* which are aligned with each other as viewed from the top of the sheets 21*a*–21*g* constitute an array 62, as shown in FIGS. 4 and 5.

As shown in FIG. 6A, each array 62 of the active portions 61 has a width slightly smaller than a width LB of the pressure chambers 16, and a length slightly larger than a length LC of the pressure chambers 16. That is, the individual electrodes 24 have a width slightly smaller than the width LB of the pressure chambers 16, as is apparent from FIGS. 4 and 6A. As shown in FIGS. 5 and 6A, the individual electrodes 24 and the common electrodes 25 have a length larger than the length LC of the pressure chambers 16, so that the active portion 61 sandwiched between the individual electrode 24 and the common electrode 25 has a length slightly larger than the length LC of the corresponding pressure chamber 16.

As shown in FIGS. 6A and 6B, each pressure chamber 16 takes the form of a generally rectangular parallelepiped which is elongate in the direction of length of the corresponding array 62. The pressure chamber 16 has a depth LA of 40 μm. The above-indicated width LB and length LC of the pressure chamber 16 are 250 μm and 1.8 mm, respectively. A longitudinally center position of the array 62 (in the direction of the length LC of the pressure chamber 16) is substantially aligned with a center position of the pressure chamber 16 in its longitudinal direction. The adjacent two pressure chambers 16 have a spacing distance LD of 80 μm. Namely, the adjacent two pressure chambers 16 are separated and spaced apart from each other by a partition wall having a thickness LD of 80 μm.

As described below in detail with respect to three Examples, an experimentation on the ink-jet printing head 1 constructed according to the present embodiment revealed a high degree of stability of the velocity of ink ejection at a sufficiently high value of about 9 m/sec., even at a relatively low drive voltage of 20.5 V when the actuator unit 20 is driven at a maximum frequency of 24 kHz. The experimentation also revealed a high degree of control stability of the actuator unit 20, with a small amount of variation of the ink ejection velocity to be caused by a variation of the width of a drive pulse applied to the actuator unit 20. Thus, the ink-jet printing head 1 according to the present embodiment of this invention is capable of satisfying a need of the user for an increased printing speed while maintaining a satisfactory quality of an image printed by the printing head, without an increase in the cost of manufacture of the electric circuits and driver ICs and an increase in the amount of heat generation.

EXAMPLES

An experimentation was conducted on the ink-jet printing head 1 constructed according to the illustrated embodiment described above, and two ink-jet printing heads according to two Comparative Examples wherein the pressure chambers 16 have respective depth values LA of 30 μm and 50 μm.

Figure 7:
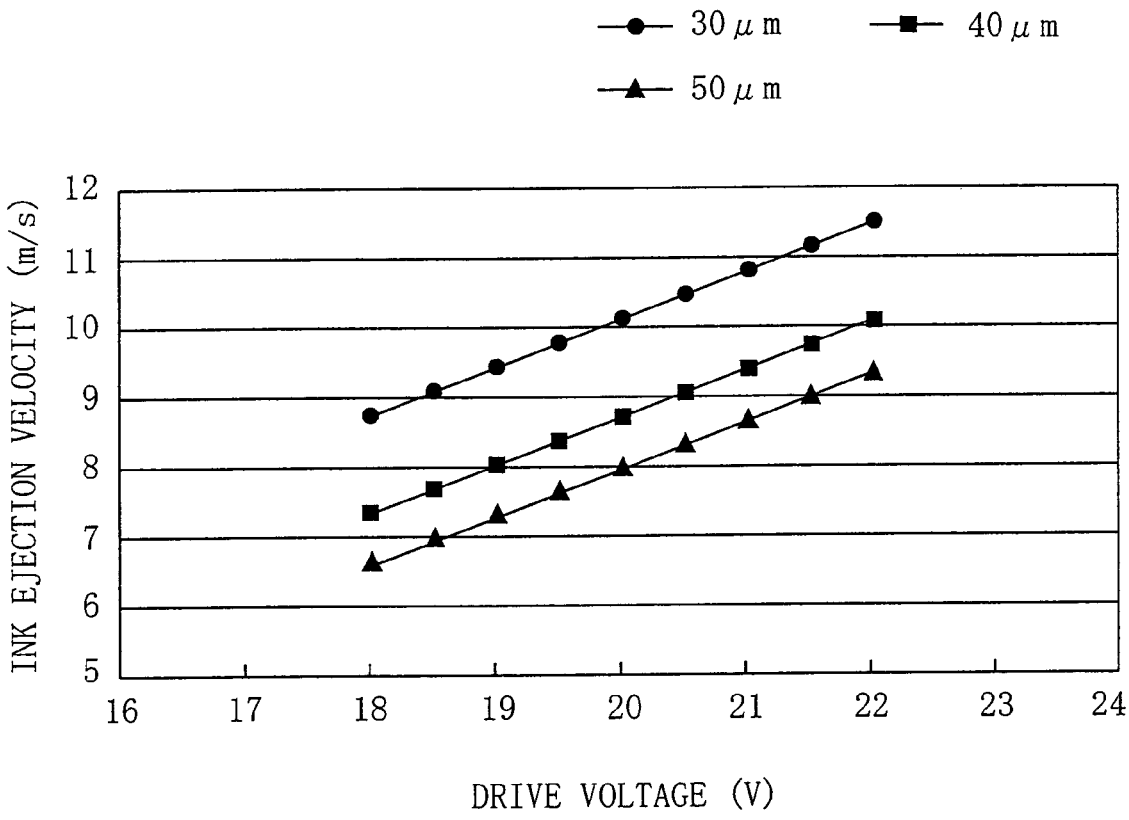
FIG. 7 is a graph indicating a relationship between a drive voltage and an ink ejection velocity in the ink-jet printing head of FIG. 1, and two comparative ink-jet printing heads wherein the depths of each pressure chamber are different from that in the printing head of FIG. 1.

The three ink-jet printing heads wherein the pressure chambers 16 have the respective different depth values LA of 40 μm, 30 μm and 50 μm were driven at a maximum frequency of 24 kHz, and at different drive voltages (V), so as to perform so-called "fill-before-fire" actions. The velocities of ink ejection were measured using the three ink-jet printing heads. The measured ink ejection velocities at the different drive voltage values (V) are indicated in the graph of FIG. 7. It will be understood from the graph of FIG. 7 that the ink ejection velocity of each printing head the pressure chambers 16 of which have the specific depth LA increases in proportion to an increase in the drive voltage, and that the ink ejection velocity at the same drive voltage value decreases with an increase in the depth value LA of pressure chambers 16. It will therefore be understood from the graph of FIG. 7 that the required drive voltage (V) and the ink ejection velocity (m/s) can be lowered and increased with an increase in the depth LA of the pressure chambers 16.

Figure 8:
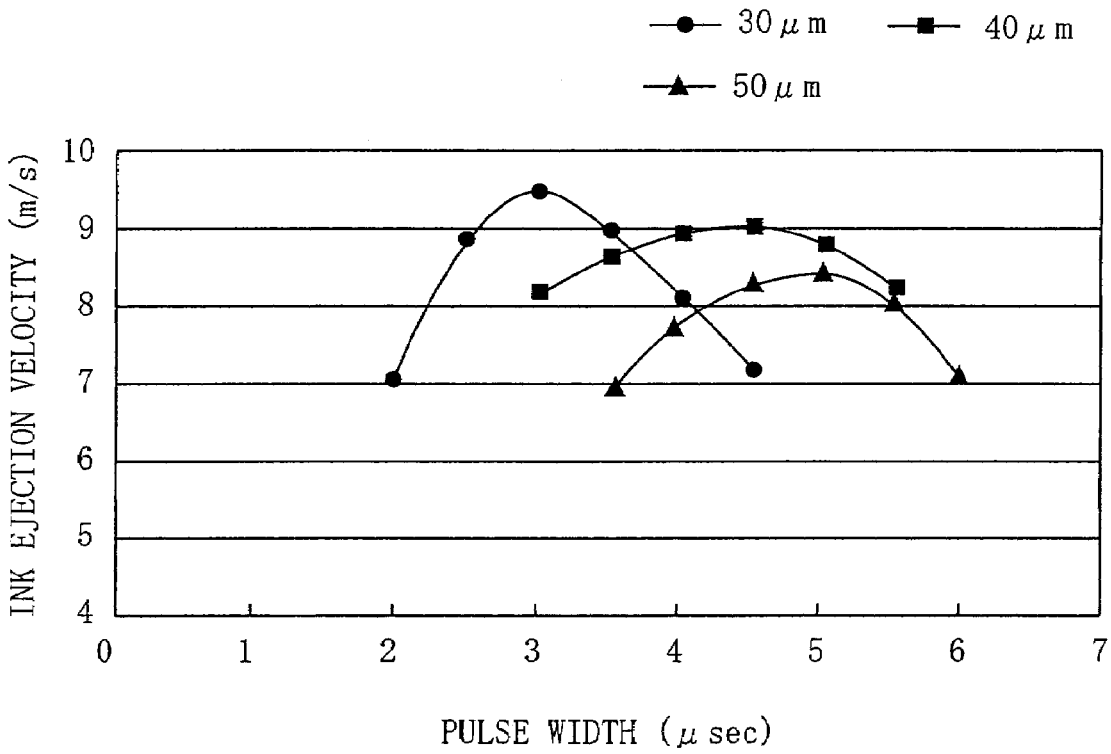
FIG. 8 is a graph indicating a relationship between a drive pulse width and the ink ejection velocity in the ink-jet printing head of FIG. 1 and the two comparative ink-jet printing heads of FIG. 7.

Then, the three ink-jet printing heads were operated with different widths of the drive pulse, at the maximum frequency of 24 kHz and at the drive voltage of 20.5 V. The ink ejection velocities measured at the different pulse widths of the three printing heads are indicated in the graph of FIG. 8. It will be understood from the graph of FIG. 8 that the maximum rate of variation or change of the ink ejection velocity with a variation or change of the pulse width is significantly lower in the printing head 1 of the illustrated embodiment the pressure chambers 16 of which have the depth LA of 40 μm, than in the two printing heads of the Comparative Examples the pressure chambers 16 of which have the depths LA of 30 μm and 50 μm, respectively. In other words, the amount of variation of the ink ejection velocity with the variation of the pulse width can be reduced where the depth LA of the pressure chambers 16 is selected to be about 40 μm.

Where the depth of each pressure chamber is greater than 45 μm, the amount of the ink in the pressure chamber is inevitably increased. In this case, a comparatively high drive voltage needs to be applied to the active portion of the actuator unit to obtain a large amount of deformation of the active portion for permitting the ink droplet to be ejected at a desired high velocity. On the other hand, where the depth of each pressure chamber is less than 35 μm, the amount of the ink in the pressure chamber is decreased, so that the amount of deformation of the active portion for permitting the ink droplet to be ejected at a desired high velocity need not be large. In this case, however, since the amount of the ink in the pressure chamber is relatively small, the deformation of the active portion of the actuator unit tends to easily act on the ink in the pressure chamber, so that the ink ejection velocity may undesirably suffer from a variation due to a variation of the pulse width of the drive pulse applied to the actuator unit.

Taking both of the results of FIGS. 7 and 8 into consideration, it can be concluded that the ink-jet printing head 1 of the illustrated embodiment the pressure chambers 16 of which have the depth value LA of 40 μm is advantageous over the printing heads of the Comparative Examples, in order to assure a sufficiently high ink ejection velocity together with a sufficient reduced amount of variation of the ink ejection velocity due to a variation of the drive pulse width, while maintaining the required drive voltage at a comparatively low value at the maximum drive frequency of 24 kHz. It is noted that results similar to those indicated by the graphs of FIGS. 7 and 8 were obtained where the experimentation was conducted by using a plurality of different kinds of ink currently available.

As described above, however, the depth LA of the pressure chambers 16 in the ink-jet printing head according to the principle of the present invention may be selected within a range of 35 μm–45 μm, preferably 37 μm–43 μm, more preferably 38 μm–42 μm and most preferably 39 μm–41 μm.

In the Examples described above, the experimentation was conducted with the width LB of 250 μm and the length LC of 1.8 mm of the pressure chambers 16. However, the results of experimentations conducted with different values of the width LB and length LA of the pressure chambers 16 are considered to have tendencies similar to those of the Examples described above, provided that the depth LA of the pressure chambers 16 is held within the range of 35 μm–45 μm, and the width LB and length LC are not considerably different from the values 250 μm and 1.8 mm of the Examples.

In the ink-jet printing head 1 of the illustrated embodiment of the present invention, the ink ejection velocity is made higher than in the known ink-jet printing head, without an increase in the required drive voltage, and the stability of control of the actuator unit 20 is improved, so that the stability in quality of an image formed by the ejected ink droplets is accordingly improved. Further, the maximum drive frequency of the actuator unit 20 in the present ink-jet printing head 1 is increased as compared with that in the known ink-jet printing head, whereby the printing speed is significantly increased in the present ink-jet printing head.

While the single embodiment of this invention has been described above, it is to be understood that the invention is not limited to the details of this specific embodiment, and may be embodied with various changes and modifications, which may occur without departing from the sprit and scope of the present invention defined in the appended claims.

For instance, the depth LA of each pressure chamber 16 is not limited to 40 μm, but may be suitably selected within a range of 35 μm–45 μm. From the standpoint of the advantages obtained according to the present invention, the depth LA of the pressure chamber 16 is preferably selected within a range of 37 μm–43 μm, more preferably within a range of 38 μm–42 μm, and most preferably within a range of 39 μm–41 μm.

Although the pressure chamber 16 has the width LB of 250 μm and the length LC of 1.8 mm in the illustrated embodiment, the width LB may be selected within a range of 150 μm–300 μm, and the length LC may be selected within a range of 1.0 mm–4.0 mm. It is noted that the maximum drive frequency is changed with a change in the length LC of the pressure chamber 16. It will also be understood that the advantages of the present invention described above may be obtained even where the width LB and length LC of the pressure chamber 16 are selected outside the ranges indicated above, provided that the depth LA is selected within the specified range of 35 μm–45 μm.

The configuration of the pressure chamber 16 is not limited to the elongate generally rectangular parallelepiped, and may be any other elongate configuration such as an elongate hexagon prism. Further, the actuator unit 20 may have an arrangement other than that of the illustrated embodiment.

What is claimed is:

1. An ink-jet printing head comprising a flow-passage unit and an actuator unit laminated on each other, said flow-passage unit having nozzles, pressure chambers communicating with said nozzles, respectively, and a common manifold communicating with an ink supply source, and said actuator unit being operable to apply pressure to ink in each pressure chamber, and wherein each of said pressure chambers communicates at one of opposite longitudinal ends thereof with a corresponding one of said nozzles, and at the other of said opposite longitudinal ends with said common manifold, and is formed so as to be open in one of opposite surfaces of said flow-passage unit, such that said each pressure chamber is partially defined by said actuator unit, said flow passage unit having for each nozzle one and only one flow passage for communication between said each nozzle and said common manifold through a corresponding one of said pressure chambers, wherein each of said pressure chambers has a depth of 35 μm–45 μm in a direction perpendicular to said one of opposite surfaces of said flow-passage unit.

2. The ink-jet printing head according to claim 1, wherein said flow-passage unit includes a first plate through which said pressure chambers are formed, a second plate formed with said ink supply source, and a third plate formed with said nozzles, said first plate being fixed to said actuator unit and said second plate being sandwiched by said first and third plates.

3. The ink-jet printing head according to claim 2, wherein said actuator unit includes a plurality of piezoelectric sheets that are stacked while sandwiching a plurality of individual electrodes and a common electrode alternately, said actuator unit having a plurality of active portions that are defined over said respective pressure chambers by said stacked individual electrodes and said common electrodes and are deformable to apply the pressure to the ink in said respective pressure chambers.

4. The ink-jet printing head according to claim 1, wherein said depth of said each pressure chamber is selected within a range of 37 μm–43 μm.

5. The ink-jet printing head according to claim 1, wherein said depth of said each pressure chamber is selected within a range of 38 μm–42 μm.

6. The ink-jet printing head according to claim 1, wherein said depth of said each pressure chamber is selected within a range of 39 μm–41 μm.

7. The ink-jet printing head according to claim 1, wherein said each pressure chamber has a width of 150 μm–300 μm in a direction perpendicular to a longitudinal direction thereof in which said opposite longitudinal ends are opposed to each other.

8. The ink-jet printing head according to claim 1, wherein said each pressure chamber has a length of 1.0 μm–4.0 mm in a longitudinal direction thereof in which said opposite longitudinal ends are opposed to each other.

9. The ink-jet printing head according to claim 1, wherein said depth of said each pressure chamber is about 40 μm.

10. The ink-jet printing head according to claim 9, wherein said each pressure chamber has a width of about 250 μm in a direction perpendicular to a longitudinal direction thereof in which said opposite longitudinal ends are opposed to each other, and a length of about 1.8 mm in said longitudinal direction, said ink-jet printing head being capable of ejecting droplets of the ink from said nozzles at a velocity of about 9 m/sec. when said actuator unit is driven at a maximum drive frequency of about 24 kHz with a drive voltage of about 20.5 V.

* * * * *